US008950348B2

(12) United States Patent
Neibauer

(10) Patent No.: US 8,950,348 B2
(45) Date of Patent: Feb. 10, 2015

(54) VESSEL MOORING ARRANGEMENT

(76) Inventor: Lance Neibauer, Bend, OR (US)

( * ) Notice: Subject to any disclaimer, the term of this patent is extended or adjusted under 35 U.S.C. 154(b) by 0 days.

(21) Appl. No.: 13/506,729

(22) Filed: May 14, 2012

(65) Prior Publication Data

US 2013/0298818 A1 Nov. 14, 2013

(51) Int. Cl.
*B63B 21/00* (2006.01)

(52) U.S. Cl.
USPC ..... 114/230.1; 114/230.2; 114/230.27

(58) Field of Classification Search
USPC ..... 114/219, 230.1, 230.2, 230.26, 230.27
See application file for complete search history.

(56) References Cited

U.S. PATENT DOCUMENTS

| | | | | |
|---|---|---|---|---|
| 3,122,120 | A | 2/1964 | Jorgenson | |
| 3,462,960 | A | 8/1969 | Bruehl | |
| 3,695,209 | A | 10/1972 | Giese | 114/230 |
| 3,873,076 | A | 3/1975 | Evans | 267/140 |
| 3,997,150 | A | 12/1976 | Hanson et al. | 267/140 |
| 4,110,989 | A | 9/1978 | Selkirk | 405/248 |
| 4,357,891 | A | 11/1982 | Sluys | 114/230 |
| 4,458,620 | A | 7/1984 | Bingham | 114/230 |
| 4,480,576 | A | 11/1984 | Mills | |
| 4,488,502 | A | 12/1984 | Girard | 114/230 |
| 4,726,313 | A | 2/1988 | Neal | 114/230 |
| 5,174,234 | A | 12/1992 | Ryan | 114/230 |
| 5,184,562 | A | 2/1993 | Hallin | 114/219 |
| 5,265,553 | A | 11/1993 | Brydges | 114/230 |
| 5,307,753 | A | 5/1994 | Besonen et al. | 114/230 |
| 5,341,757 | A | 8/1994 | Digicomo | 114/230 |
| 5,361,716 | A | 11/1994 | Cotton | 114/230 |
| 5,425,324 | A | 6/1995 | Cotton | 114/230 |
| 5,467,727 | A | 11/1995 | Godvin | 114/230 |
| 5,493,991 | A | 2/1996 | Wright et al. | 114/230 |
| 5,513,592 | A | 5/1996 | Cotton | 114/219 |
| 5,575,234 | A | 11/1996 | Dysarz | 114/230 |
| 5,588,387 | A | 12/1996 | Tellington | 114/261 |
| 5,588,782 | A | 12/1996 | Haring | 495/218 |
| 5,937,781 | A | 8/1999 | Isella et al. | 114/230.2 |
| 6,532,885 | B1 * | 3/2003 | Cordoba | 114/230.26 |
| D473,508 | S * | 4/2003 | Mastrofilipo, Jr. | D12/317 |
| 7,921,791 | B2 * | 4/2011 | Brelsford | 114/219 |

OTHER PUBLICATIONS

"Tide Ring" : tide ring.com.

* cited by examiner

*Primary Examiner* — Lars A Olson
(74) *Attorney, Agent, or Firm* — Don B. Finkelstein; Law Office of Don B. Finkelstein

(57) ABSTRACT

A split ring vessel mooring arrangement having floats thereon which may be installed on a post or piling over the top thereof or, in the case of the top being covered by a deck or other structure making access thereto impossible may be pivotally opened and wrapped around the post or piling and then re-secured together.

14 Claims, 12 Drawing Sheets

VESSEL MOORING ARRANGEMENT

BACKGROUND OF THE INVENTION

1. Field of the Invention

This invention relates to the art of securing or mooring boats floating on a body of water to a piling or other type of post.

2. Description of the Prior Art

The securing or mooring a boat that is floating on a body of water to a fixed piling or other post at or adjacent to a dock or other structure has been a problem that a multitude of devices have attempted to solve over the many years of human history. Many of the prior devices have proven to be practical for limited types of fixed structures to which it is desired to moor the boat. However, due to the great variety of fixed strictures and the configuration thereof, there has not yet been provided a vessel mooring device that is adaptable for use in the two most common types of fixed structures. The first of the two most common fixed structure is one in which there is a post or piling that has a top portion that may rise above the water level and has no other structure prohibiting or preventing access to the top of the post or piling. The second of the two most common fixed structures is one in which there is a post or piling having a top portion above the surface of the water level but which also has other structure such as a dock, walkway, deck or the like on or adjacent to the top of the post or piling which prevents access to the top of the post or piling.

The devices previously proposed for mooring a vessel to a fixed post or piling for the situations wherein the top of the post or piling is accessible and where the top of the post or piling is inaccessible have not satisfactorily been able to provide such a mooring configuration in both situations.

Accordingly, it is an object of the present invention to provide a vessel mooring device that allows a vessel to be secured to a post or piling in which the top of the post or piling is both accessible and inaccessible.

It is another object of the present invention to provide a vessel mooring device that allows a vessel to be secured to a post or piling in which the top of the post or piling is both accessible and inaccessible and which floats on the top of the water level.

It is another object of the present invention to provide a vessel mooring device that allows a vessel to be secured to a post or piling in which the top of the post or piling is both accessible and inaccessible and which is provided with float members thereon to keep the mooring device floating on the top of the water level even though the water level may rise or fall depending on, for example, tide action or other action effecting a change in the water level.

It is another object of the present invention to provide a vessel mooring device that allows a vessel to be secured to a post or piling in which the top of the post or piling is both accessible and inaccessible and which is provided with float members thereon to keep the mooring device floating on the top of the water level even though the water level may rise or fall depending on, for example, tide action or other action effecting a change in the water level and in which the float members are prevented from rubbing against the post or piling.

It is yet another object of the present invention to provide a vessel mooring device that allows a vessel to be secured to a post or piling which is economical to manufacture, easy to use and is of a relatively compact configuration.

SUMMARY OF THE INVENTION

The above and other objects of the present invention a re achieved, in a preferred embodiment thereof by providing a wire like body member, which may be tubular or solid having a first portion and a second portion. Each of the first portion and the second portion have a coupling end and a pivot end. The pivot end of said first portion is pivotally coupled to the pivot end of said second portion to allow relative pivotal movement of the first portion with respect to the second portion. A pivot pin, which may be, for example a double headed rivet configuration or any other desired configuration to allow such relative pivotal movement is utilized to couple the two pivotal ends together. In the preferred embodiments of the present invention, the pivot ends of the first portion and the second portion are flattened and appropriate apertures are provided therethrough to allow insertion of the pivot pin.

The coupling end of said first portion is detachably mountable on the coupling end of the second portion to provide detachable coupling therebetween. For the condition of the coupling ends of the first portion and the second portion so coupled together, the body member defines a substantially ring like configuration having a center line, and the body member lies substantially in a plane. The coupling ends of the first and second portions may be flattened and apertures provided therein to allow insertion of a locking pin, which may be comprised of a nut and bolt to allow the detachable coupling therebetween.

Each of the first portion and second portion has a loop like section upstanding from the plane of the body member and intermediate the coupling end and the pivot end of each of the first portion and said second portion. In preferred embodiments of the present invention, the loop like sections also extend outwardly from the plane of the body member away from the centerline thereof. A strap like member may be placed around each of the loop like sections in regions adjacent the other parts of the first portion and second portion to leave the upper part of the loop like sections free for access therethrough of a line or other securing device from a vessel. The loop like sections are in diametrically opposed relationship on the body member.

A plurality of float like members having a density less than that of water are provided on the body member and at least one of the plurality of float like members mounted on each of the first portion and the second portion of said body member. In preferred embodiments of the present invention one of the float like members is mounted on each of the first portion and second portion adjacent to the pivot ends and coupling ends of the body member. The float like members as so placed are spaced from the loop like sections of the body member. The float like members maintain the body member at the surface of the water despite the rising or falling of the surface of the water due to tides, wind or the like. The floats are sized and spaced substantially apart so that the body member and loop like section on one of the first portion and second portion is brought to bear against the post or piling for the condition of an outwardly directed force being applied to the loop like section of the other of the first portion and second portion and the floats are free of engagement with the post or piling. Such outwardly direct force may be caused by movement of a vessel attached to the loop like section on the other of the first portion and second portion.

The circumferential size of the ring like configuration of the body member for the condition of the first portion and second portion of the body member coupled together is selected to be such that there is adequate clearance between the body member and the floats thereon and the post or piling to prevent the floats from engaging the post or piling. Such engagement could damage or destroy one or more of the floats.

In operation, the body member is placed around the post or piling to which the vessel is to be moored. For the condition of the top of the post or piling being accessible, the body member may be just slipped thereover. For the condition wherein the top of the post or piling is not accessible, the coupling ends of the first portion and second portion of the body member are detached by removing the locking pin to allow the opening of the body member by the relative pivotal motion therebetween on the pivot pin. The open body member may then be inserted around the post or piling and the coupling ends of said first portion and said second portion are coupled together by insertion of the locking pin.

A vessel is connected to the loop like section on one of the first portion and the second portion of the body member by any suitable means such as a rope, a clevis or the like. As wind, tidal movement or the like tends to move the vessel away from the post or piling, an outwardly directed force is applied to the body member causing the other of the first portion and second portion of the body member to engage the post or piling thereby restraining the vessel from further movement.

BRIEF DESCRIPTION OF THE DRAWING

The above and other embodiments of the present invention my be more fully understood from the following detailed description taken together with the accompanying drawing wherein similar reference characters refer to similar elements throughout and in which.

DESCRIPTION OF THE PREFERRED EMBODIMENTS

Figure 1:
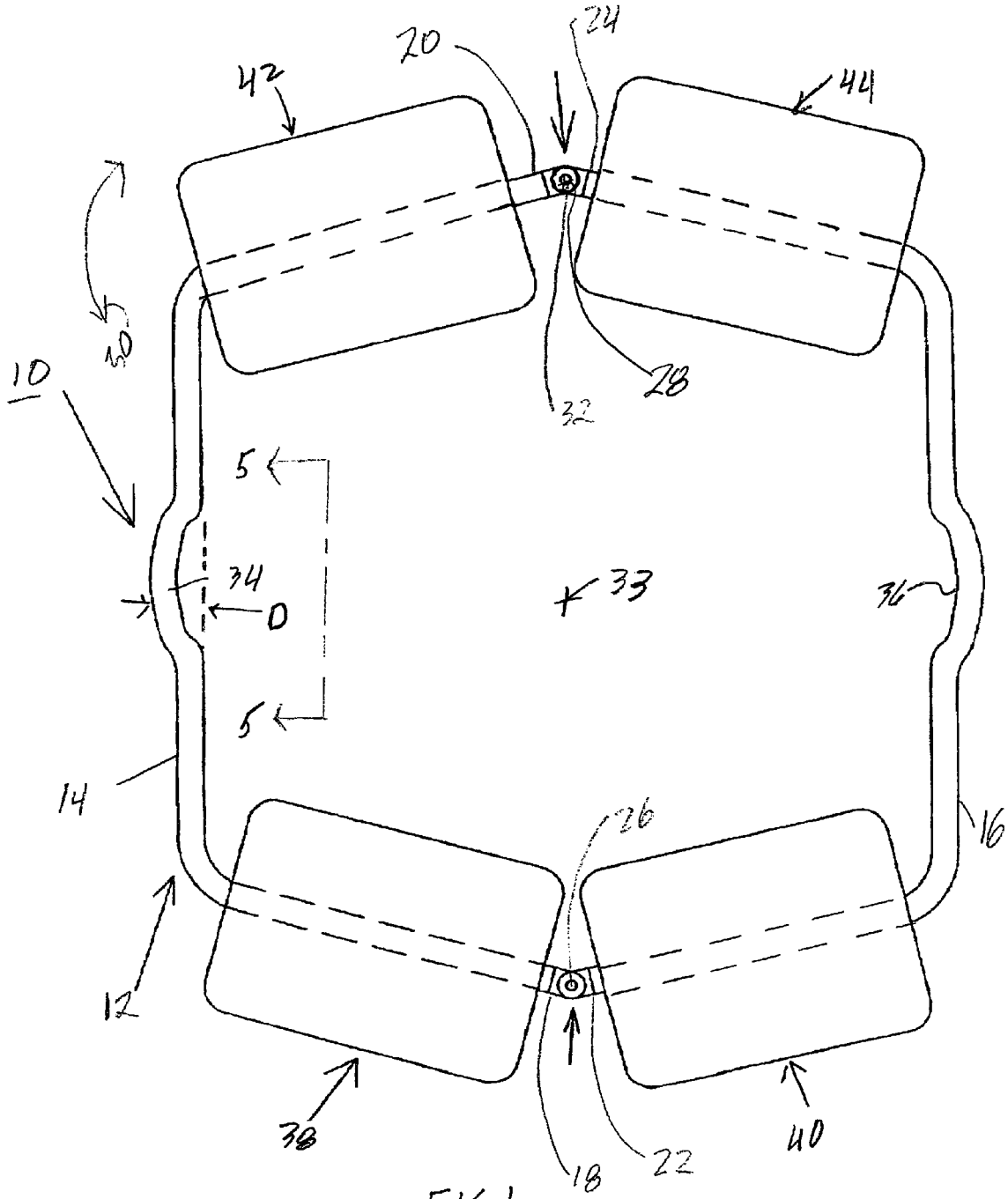
FIG. 1 illustrates a preferred embodiment of a vessel mooring arrangement of the present invention in the closed position thereof.

Referring now to the drawing, there is illustrated in FIG. 1 a preferred embodiment, generally designated 10, of a vessel mooring arrangement, or float tie, of the present invention. The vessel mooring arrangement 10 has a wire like body member 12, which may be a solid or tubular, as described below, has a first portion 14 and a second portion 16. The first portion 14 has a coupling end 18 and a pivot end 20. The second portion 16 has a coupling end 22 which is detachably coupled to the coupling end 18 of the first portion by suitable structure so as to conveniently allow the removal thereof and such structure is indicated 26 and may be a pin, a nut and bolt or the like which allows the first end 22 of the second portion 16 to be detachably coupled to the first end 18 of the first portion 14.

The second end 20 of the first portion 14 is pivotally coupled to the second end 24 of the second portion 16 for rotation about an axis 28 perpendicular to the plane of the paper in the directions indicated by the arrow 30 for the condition of the first end 18 of the first portion 14 detached.

A pivot pin 32 which may be, for example, a Pit Pin, or which may be a bolt and nut, a double headed rivet, or any other suitable structure pivotally couples the pivot ends 20 and 24 of the first and second portions 14 and 16, respectively, in a loose fashion so as to allow full rotational movement as indicated by the double ended arrow 30 about the pivot pin 32.

In the closed position as shown on FIG. 1, the embodiment 10 forms a substantially ring like structure having a centerline 33 and the body member 12 lies substantially in a plane except for the two hoop like sections 34 on first portion 14 and 36 on second portion 16 and the hoop like members 3 and 36 are upstanding from the plane defined by the body member 12 and also outwardly extending from the centerline 32 as described below in greater detail. In the preferred embodiments of the present invention the hoop like members 34 and 36 are intermediate the pivot ends and the coupling ends of the first and second body portions 14 and 16 and the pivot ends of the first and second body portions 14 and 16. Since the first portion 14 and the second portion 16 of the body member 12 are identical, the embodiment 10 is thus economical to fabricate. In the event of damage to a float, the float may be easily replaced with a new float.

Figure 3:
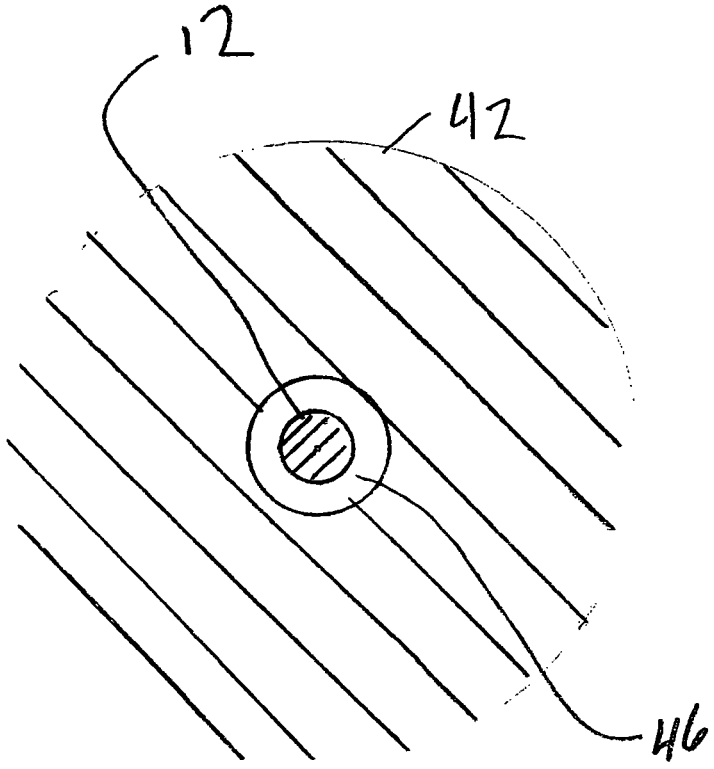
FIG. 3 is a sectional view along the line 3-3 of FIG. 2.

A plurality of float members 38, 40, 42 and 44 are mounted on the body member 12 and each of the float members 38, 40, 42 and 44 are substantially identical. The float members 38, 40, 42 and 44 have a density less than the density of the water in which the embodiment 10 may be used and may be fabricated from wood, plastic such as polystyrene or polypropylene, or the like. Float 38 is adjacent the coupling end 18 of first body portion 14 and float 40 is adjacent the coupling end 22 of the second portion 16. The float members 38, 40, 42 and 44 are generally tubular in shape and the body member 12 extends through a central aperture 46 (FIG. 3) in each of the float members 38, 40, 42 and 44. However, in some applications it may be desired to have the floats 38, 40, 42 and 44 mounted on the body member 12 other than through a central aperture 46.

Figure 4:
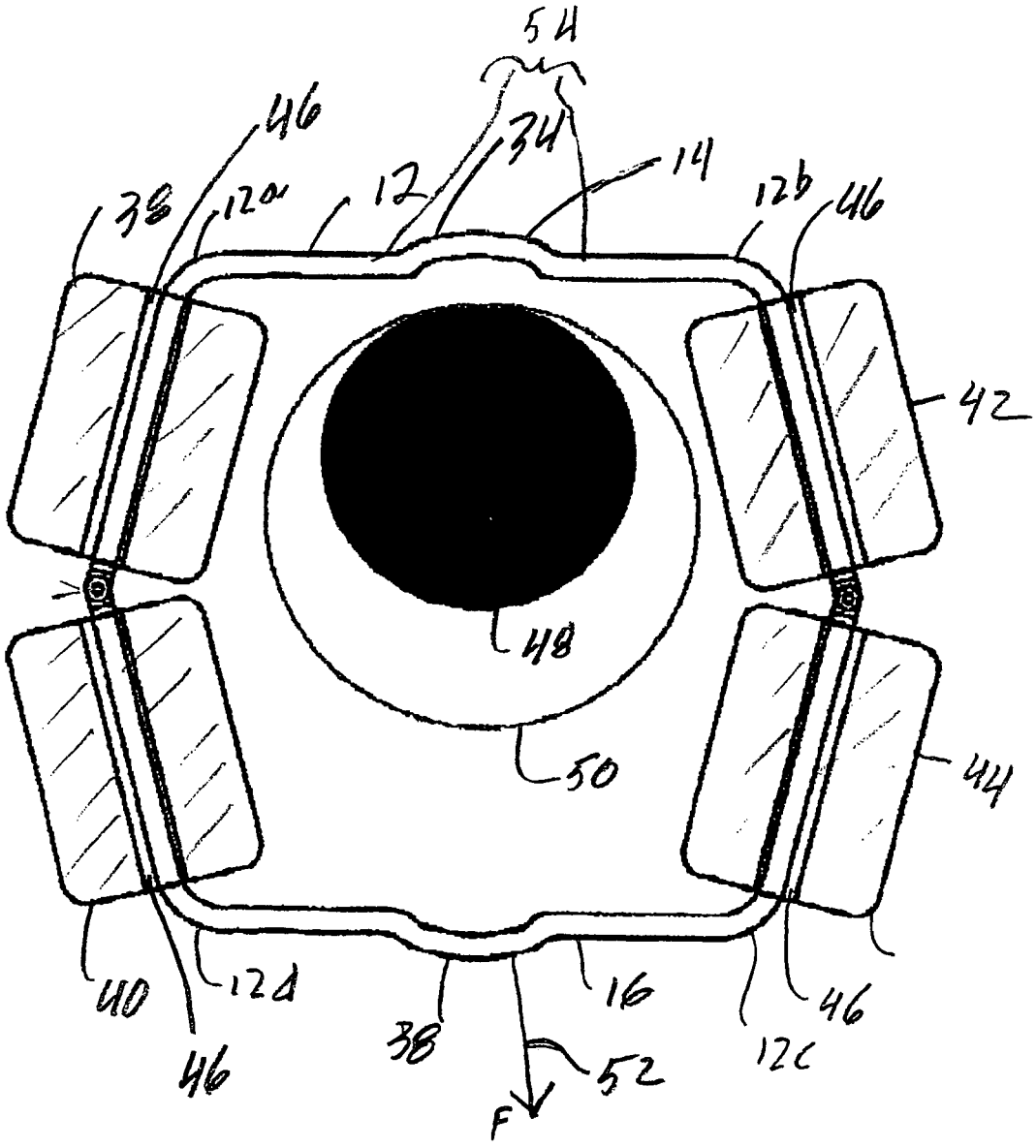
FIG. 4 illustrates the preferred embodiment of FIG. 1 of the present invention as installed on a post or piling.

FIG. 4 illustrates the embodiment installed on a post or piling 48 or 50. Post or piling 48 represents a post or piling having an outer diameter of about 6¾ inches and piling 52 represents a piling having an outer diameter of about 9 inches. Such dimensions for the post or piling 48, 50 are typical for the dimensions of such structures generally found in ocean/dock pilings. However, the embodiment 10 may be dimensioned to accommodate any size piling.

A boat or other type vessel that is floating on the water adjacent to, for example the post or piling 48,50 may be tied or other wise secured to the loop like portion 38 and may exert a force F indicated by the arrow 52 outwardly from the post or piling 48, 50. As such force F is applied on the body member 12, the embodiment 10 is pulled in the direction of the force F until the first body portion 14 in regions adjacent the hoop like section 34, as indicated at 54 is against the post or piling 48, 50.

The floats 38, 40, 42 and 44 are free if contact with the post or piling 48, 50 and the corner bends 12*a*, 12*b*, 12*c* and 12*d* keep the floats 38, 40, 42 and 44 from moving towards the hoop like sections 34, 38. The floats 38, 40, 42 and 44 are solid in construction and thus are not susceptible to being punctured and filled with water and thus lose the flotation capability. Since the floats are on the surface of the water, the embodiment 10 floats up and down on the post or piling 48,50 with, for example, rising and falling tides for the condition of the force F at a minimum, no slack need be provided in the line connecting a vessel to the body member 12 as indicated by arrow 52. As a result, vessels can be securely centered in narrow piling layouts and thus avoiding contact side pilings. The body member 12 and the pivot or pit pin 32 and coupling structure 26 are preferably fabricated from corrosion resistant material such a corrosion resistant steel.

Figure 5:
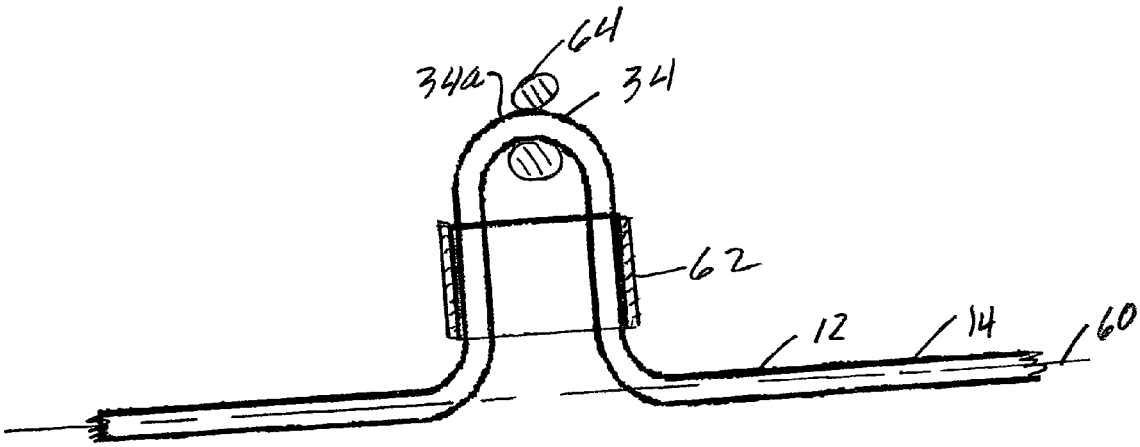
FIG. 5 is a view along the line 5-5 of FIG. 1.

FIG. 5 illustrates the loop like portion 34 of the first portion 14 of the body member 12 as viewed along the view line 5-5 of FIG. 1. As shown on FIG. 5, the loop like portion 34 extends vertically upwardly from the plane 60 that is generally defined by the non-hoop like sections 34 and 36 of the first body portion 24 and second body portion 16. A sleeve 62, which may be fabricated from nylon or any other suitable material, is wrapped around the hoop like section 34 and spaced from the peak 34*a* of hoop like section 34. It has been found that the sleeve 62 prevents a mooring line 64 which connects a vessel (not shown) to the body member 12 from sliding down the hoop like section 34 and into the water. As shown on FIGS. 1 and 2, the hoop like sections 34 and 36 extend outwardly by a distance D from the remainder of the first portion 14. It has been found that with a mooring line 64 put into tension due to relative movement of the vessel with respect to post or piling 48, 50 (FIG. 4) the force F is directed upwardly from the plane 60 and thereby causes the portion 54 (FIG. 4) to engage the pier or piling 48,50 at an angle to the surface of the water and the body member 12 will not ride up the post or piling. For the condition of the force F at a minimum or non-existent, the entire embodiment 10 will float up and down the post or piling 48, 50 along with the vessel.

Figure 2:
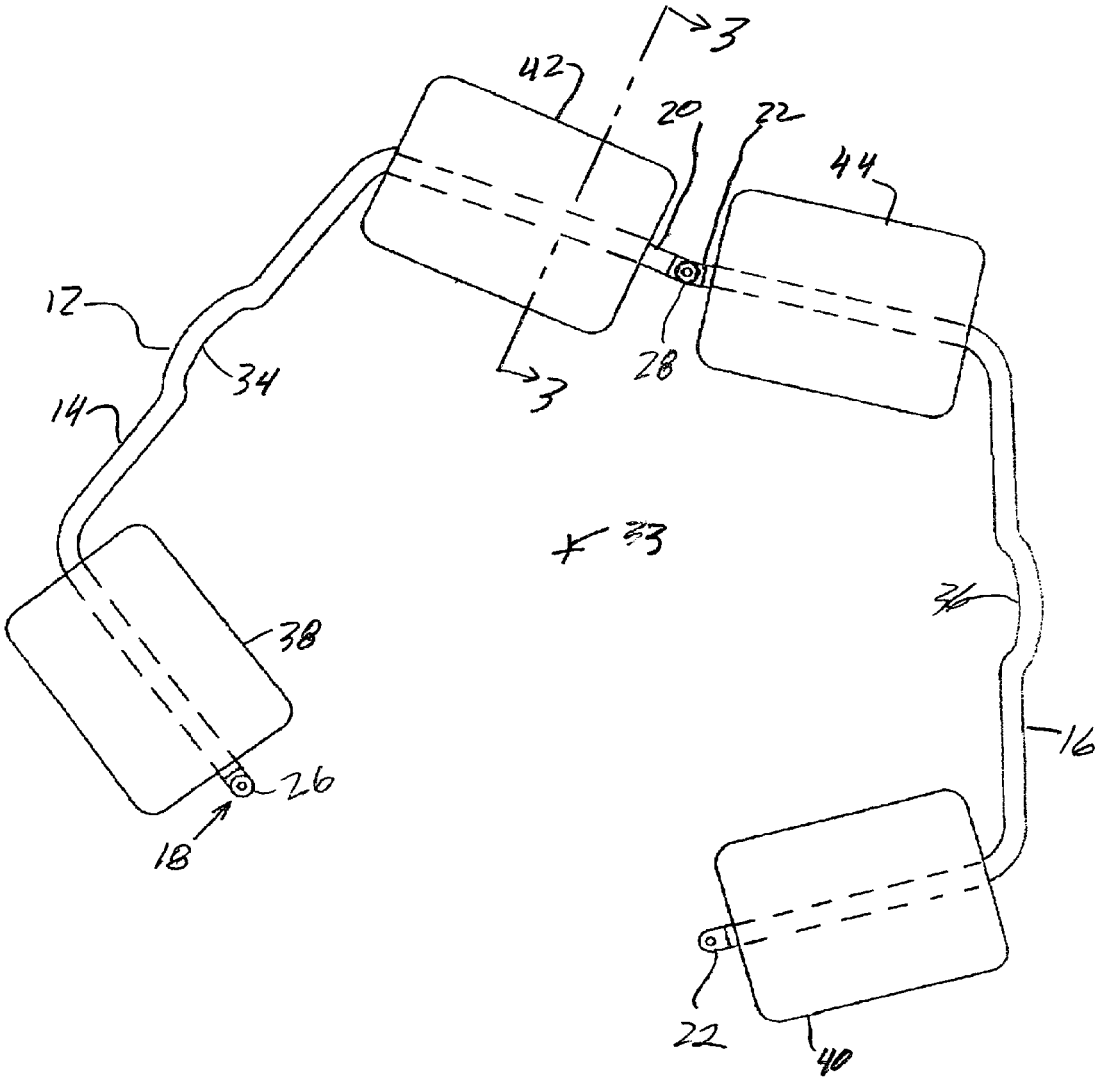
FIG. 2 illustrates the preferred embodiment of FIG. 1 of the present invention in the open position thereof.

Since the body member 12 may be opened and closed as shown on FIGS. 1 and 2, mooring of a vessel to a post or piling 48, 50 may be accomplished even though there is structure, such as a deck or the like on the top of the post or piling 48, 50 barring a fixed ring like mooring device from being placed over the top of the post or piling 48, 50.

The hoop like section 36 is fabricated similarly to the arrangement shown on FIG. 5 of hoop like section 34 and sleeve 62.

Figure 6:
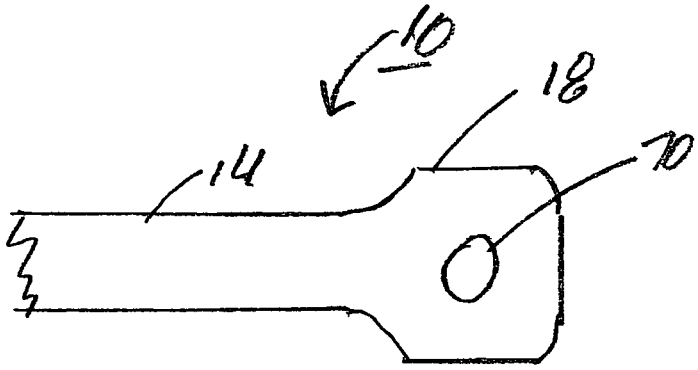
FIG. 6 illustrates the flattened end of a first or second portion of a body member as shown in FIG. 1 wherein the body member is solid.

As noted above, the coupling ends 18 and 22 as well as the pivot ends 20 and 24 of first portion 14 and second portion 16 respectively are preferably flattened so as to facilitate the interconnections therebetween. FIG. 6 illustrates the flattened coupling end 18 of first portion 14 wherein the first portion 14 is a solid wire like configuration. An aperture 70 is provided through the flattened end to allow insertion of the appropriate coupling, structure as described below. The coupling end 22 of second portion 16 and pivot ends 20 and 24 of the first portion 14 and second portion 16, respectively, are fabricated in the same manner as shown on FIG. 6.

Figure 7:
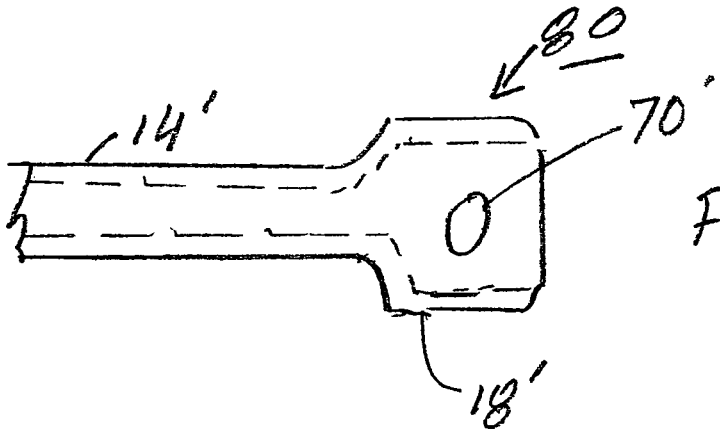
FIG. 7 illustrates the flattened end of a first or second portion of a body member as shown in FIG. 1 wherein the body member is tubular.

FIG. 7 shows the coupling end 18' of a first portion 14' of an embodiment 80 similar to embodiment 10 wherein the body member 12' is fabricated from a tubular material such as corrosive resistant steel.

Figure 8:
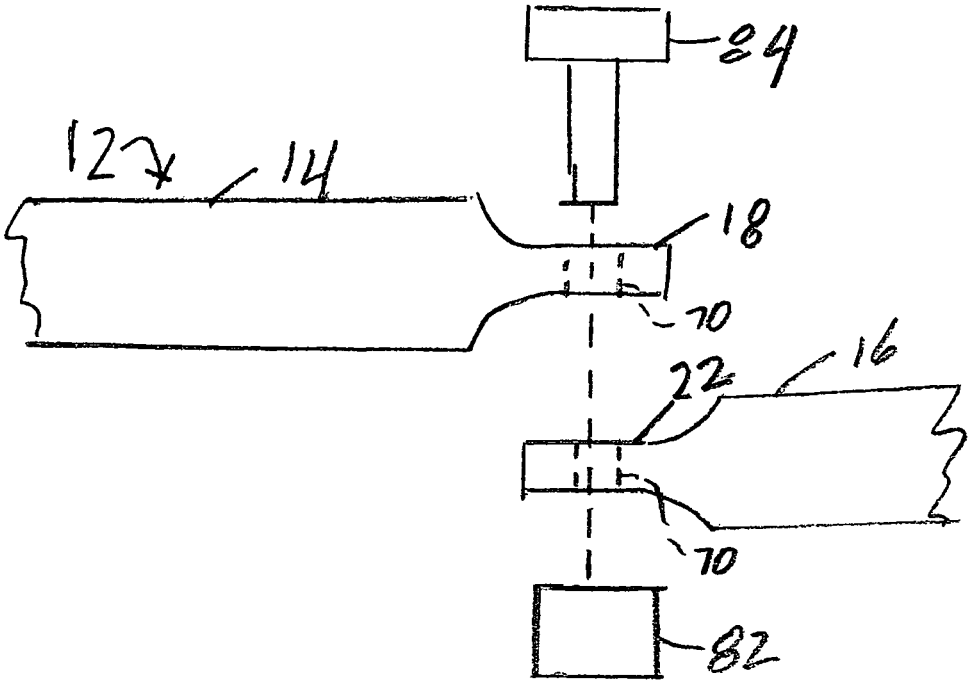
FIG. 8 is an exploded view illustrating the coupling together of the coupling ends of the first and second body portions of the embodiment shown in FIG. 1.

FIG. 8 is an exploded view showing the connection of the coupling end 18 of the first portion 14 to the coupling end 18 of the second portion 16 of the body member 12 by a nut 82 and bolt 84 extending through the apertures 70

FIG. 8 is an exploded view showing the connection of the coupling end 18 of the first portion 14 to the coupling end 18 of the second portion 16 of the body member 12 by a nut 82 and bolt 84 extending through the apertures 70

Figure 9:
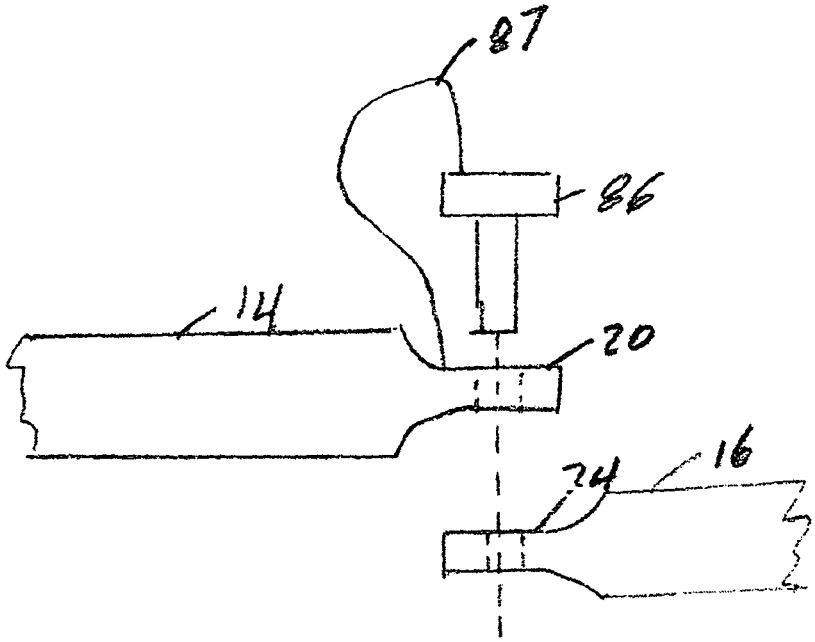
FIG. 9 is an exploded view illustrating the coupling together of the pivot ends of the first and second body portions of the embodiment shown in FIG. 1.

FIG. 9 is an exploded view showing the connection of the pivot end 20 of the first portion 14 to the pivot end 24 of the second portion 16 of the body member 12 by a pit pin 86, or similar suitable headed pin structure extending through the apertures 70. In preferred embodiments of the present invention the pit pin 86 is retained by a braided stainless steel wire as indicated by 87 extending from the pit pin 86 to the first portion 14.

Figure 10:
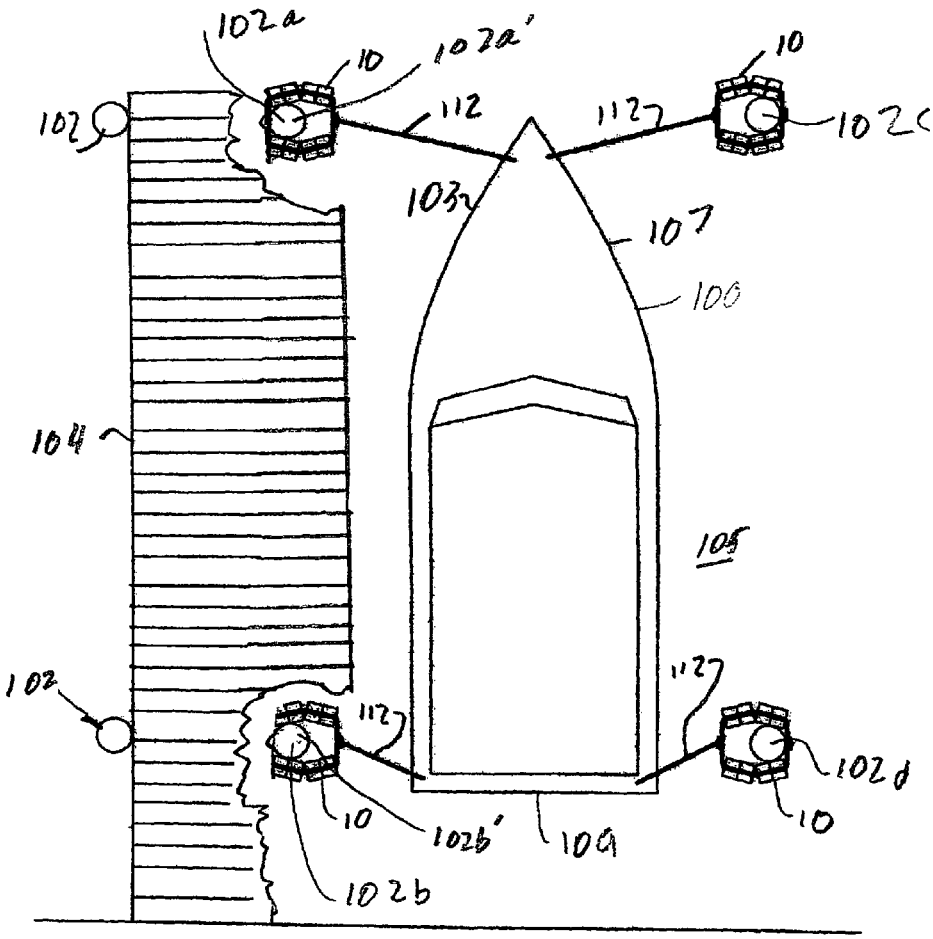
FIGS. 10 and 11 are semi schematic views of a vessel moored according to the principals of the present invention; and, FIGS. 12 and 13 are semi schematic views of a vessel moored according to the prior art.
Figure 11:
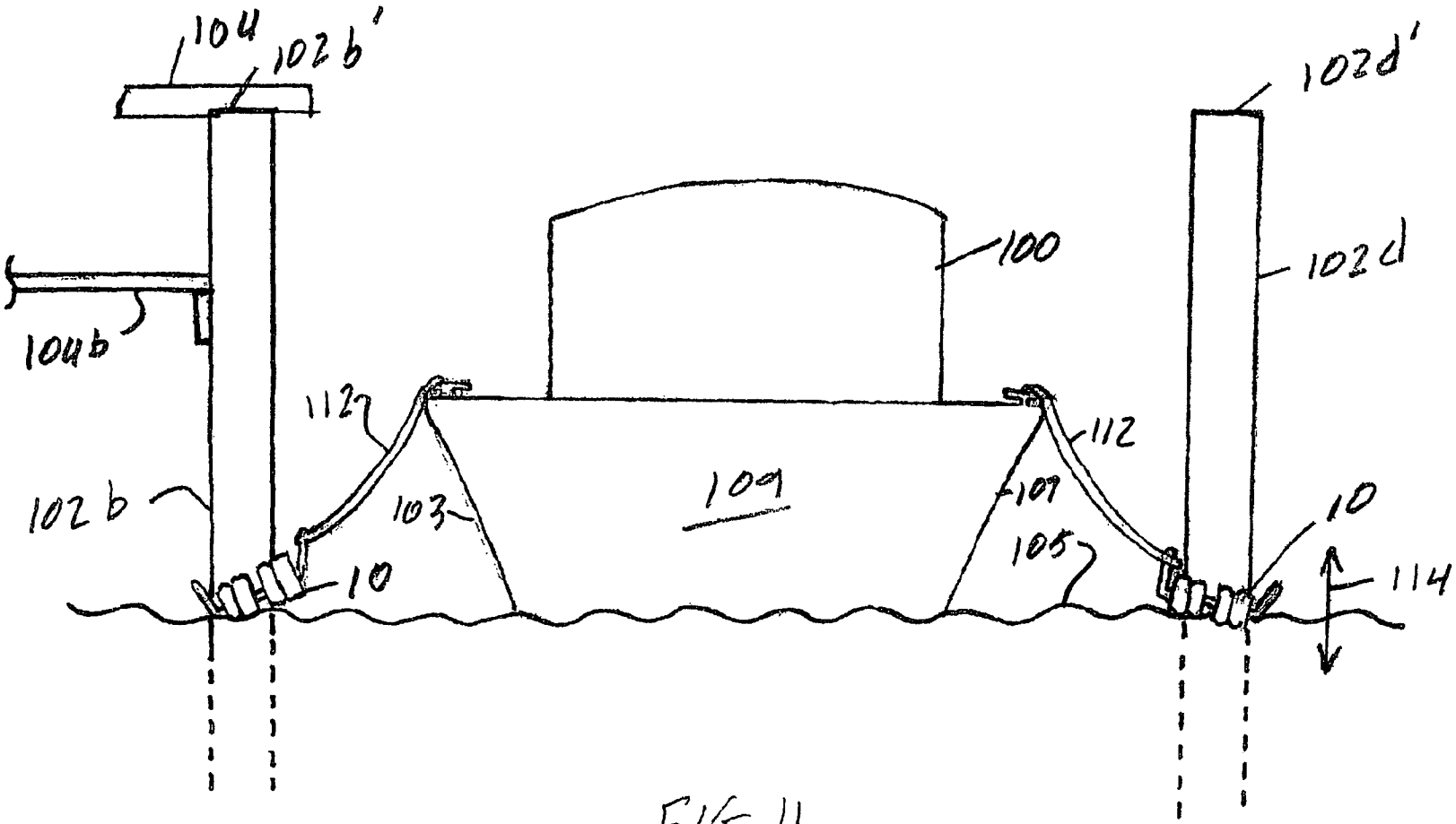

FIGS. 10 and 11 are semi schematic views of a vessel 100 moored according to the principals of the present invention. As shown on FIG. 10, there is depicted a top plan view of the vessel 100 moored by four vessel mooring arrangements or float ties 10 of the present invention as moored to pilings 102. The pilings 102*a* and 102*b* on the port side 103 of the vessel 100, may have decking 104 or similar dock structures indicted at 104 extending over the top of the pilings 102*a* and 102*b* as shown on FIG. 10, or the dock structures 104 may extend to the pilings 102*a* and 102*b* at some location between the tops 102*a'* and 102*b'* of the pilings 102*a* and 102*b* and the water level indicated at 105 upon which the vessel 100 is floating as shown at 104*b* on FIG. 11. The float ties 10 are connected to the vessel by lines 112.

On the starboard side 107 of the vessel 100 the pilings 102*c* and 102*d* may have decking such as 104 or 104*b* or the pilings 102*b* and 102*d* may be free of such decking.

As shown on FIG. 11, which depicts an elevational view of the stern 109 of the vessel 100, as moored to the pilings 102*b* and 102*d*. With the float ties 10 encircling the pilings 102*b* and 102*d*, as well as pilings 102*a* and 102*c*, the vessel 100 and the float ties 10 may move freely up and down as the tide comes in and then recedes as indicted by the double ended arrow 113 As such, no strain or tension other than as placed thereon in the initial mooring is placed on the lines 112 by changing of the level of the tide and the relative position of the vessel 100 to the pilings 102*a*, 102*b*, 102*c* and 102*d* remain unchanged despite the changes in the level of the water 105 as changed by the tide.

Figure 12:
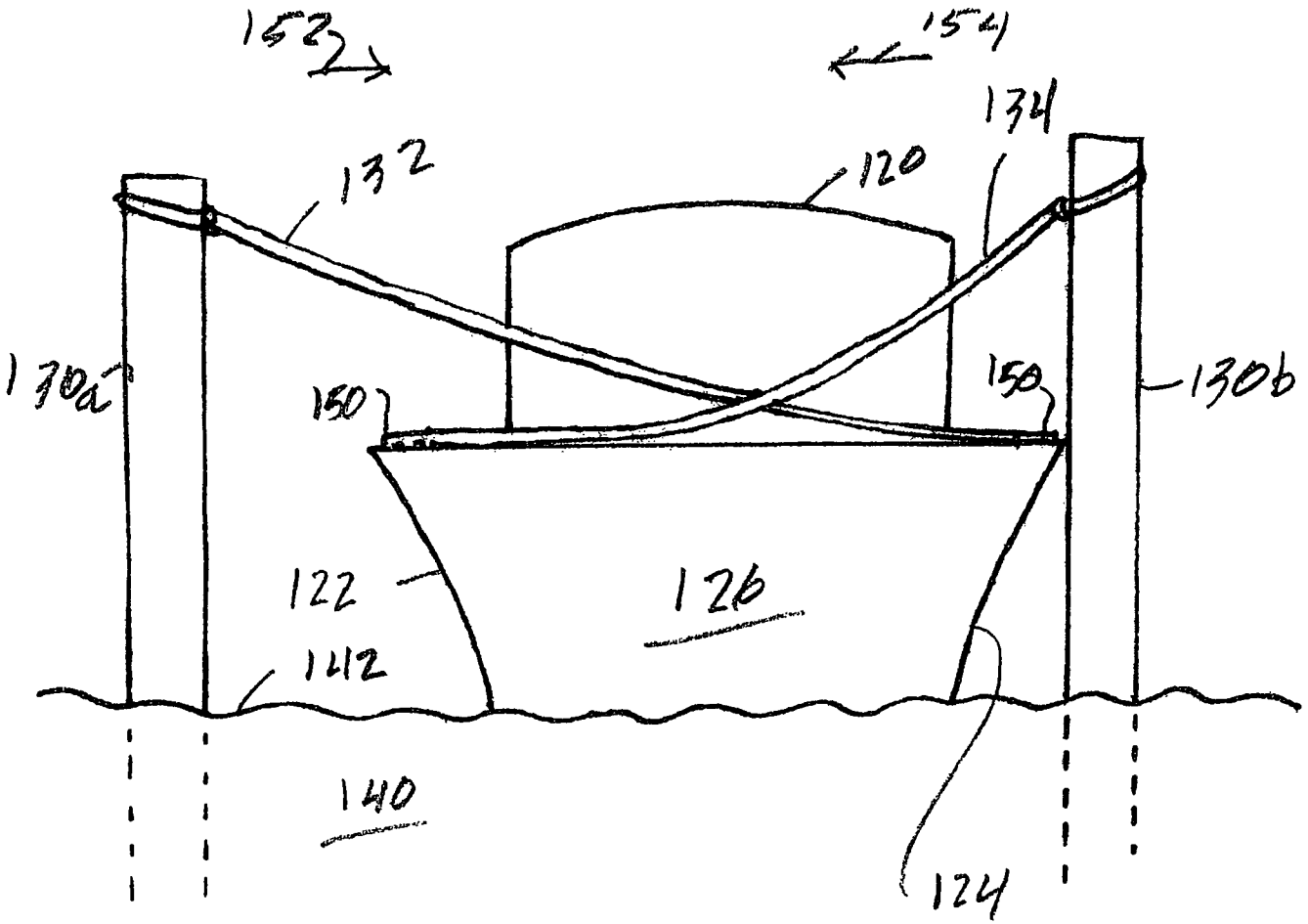
Figure 13:
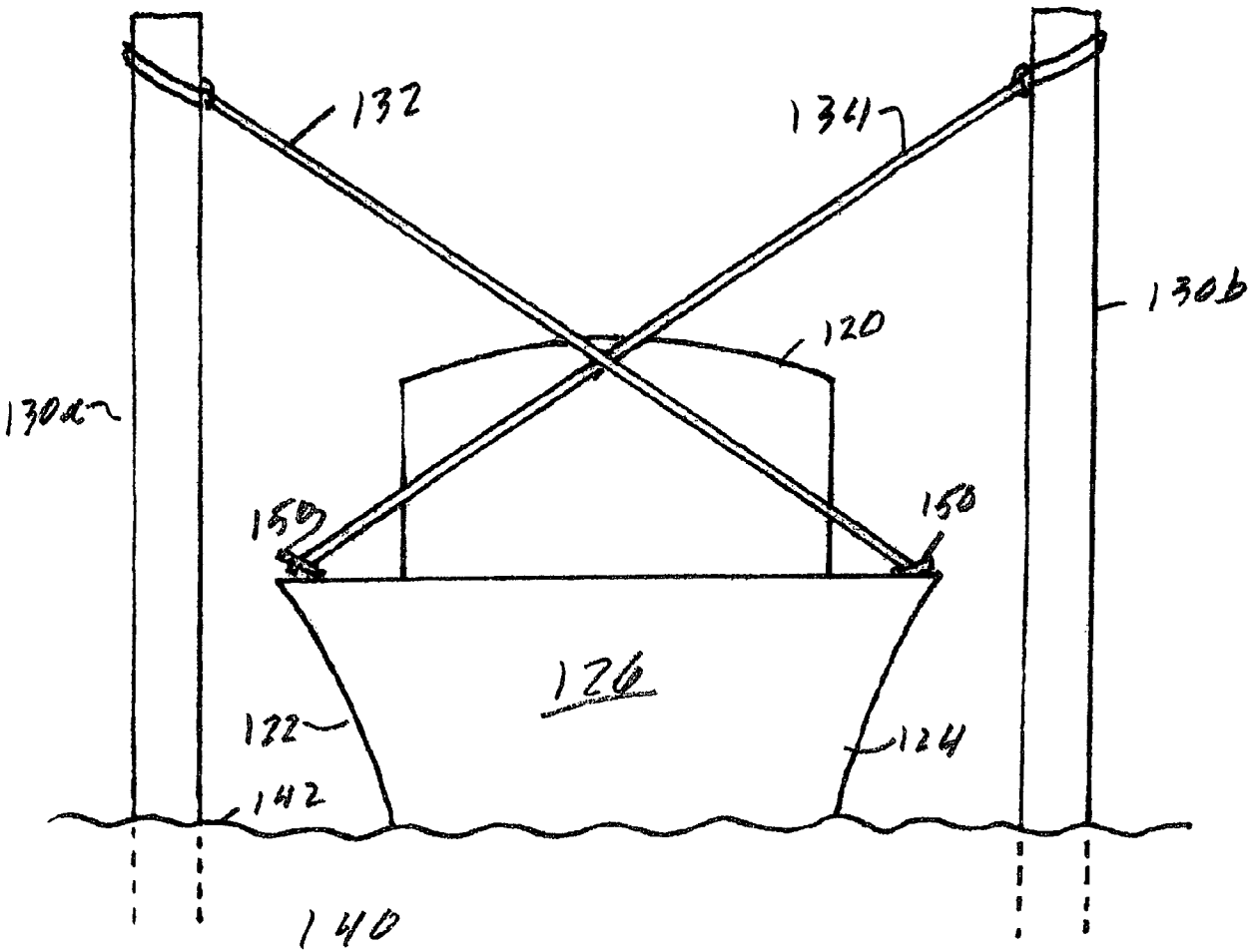

FIGS. 12 and 13 illustrate an elevational view of the stern 126 of a vessel 120 floating in the water 140 having a water surface 142 at a high tide thereof (FIG. 12) and low tide thereof (FIG. 13). The vessel is tied to the pilings 130*a* by line 132 and to the piling 130*b* by line 134. The line 132 is attached to the vessel 120 by a cleat 150 on the starboard side 124 of the vessel 120 and extends to the piling 130*a* on the port side 122 of the vessel 120. The line 134 is connected to a cleat 150 on the port side 122 of the vessel 120 and extends to the piling 130*b* on the starboard side 124 of the vessel 120. At high tide as depicted on FIG. 12, the lines 132 and 134 will become slack and the vessel may abut against the piling 130*b* as shown on FIG. 12 for a wind in the direction of the arrow 152 or against the piling 130*a* for a wind in the direction of the arrow 154.

At low tide, as depicted on FIG. 13, the lines 132 and 134 tend to be strained and put into tension. As such, the lines 132 and 134 tend to tear out the cleats 150 at low tide positions of the water surface 142.

In FIGS. 12 and 13, the pilings 130*a* and 130*b* are shown as unobstructed by a dock decking such as shown on FIGS. 10 and 11 or the tops of the pilings 130 may be accessible as shown on FIGS. 12 and 13.

Although specific embodiments of the present invention have been described above with reference to the various Figures of the drawing, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

I claim:

1. A vessel mooring arrangement, comprising, in combination:

a wire body member having a first portion and a second portion, each of said first portion and said second portion having a coupling end and a pivot end;

said pivot end of said first portion pivotally coupled to said pivot end of said second portion to allow relative pivotal movement of said first portion with respect to said second portion;

said coupling end of said first portion detachably mountable on said coupling end of said second portion to provide detachable coupling therebetween to define a substantially ring configuration of said body member having a center line, said body member lying in a plane for the condition of said coupling end of said first portion detachably coupled to said coupling end of said second portion and an open configuration for the condition of said coupling end of said first portion detached from said coupling end of said second portion;

each of said first portion and said second portion having a loop section upstanding from said plane of said body member and intermediate said coupling end and said pivot end of each of said first portion and said second portion;

a plurality of float members having a density less than that of water and at least one of said plurality of float members mounted on each of said first portion and said second portion of said body member.

2. The arrangement defined in claim 1 wherein:

said loop section of each of said first portion and said second portion extend both upwardly from said plane of said body member and outwardly away from said center line of said body member.

3. The arrangement defined in claim 2 and further comprising:

a strap member on each of said loop sections and surrounding said loop sections.

4. The arrangement defined in claim 3 wherein:

said strap members are in regions adjacent said plane of said body member.

5. The arrangement defined in claim 2 wherein:

a first of said plurality of float members mounted on said first portion of said body member in regions adjacent said pivotal end thereof;

a second of said float members mounted on said first portion of said body member in regions adjacent said coupling end thereof;

a third of said plurality of float members mounted on said second portion of said body member in regions adjacent said pivotal end thereof;

a fourth of said float members mounted on said second portion of said body member in regions adjacent said coupling end thereof.

6. The arrangement defined in claim 1 wherein:

said body member is substantially circular in cross section;

said coupling ends and said pivot ends of said first portion and said second portion of said body member have a flattened section.

7. The arrangement defined in claim 6 wherein:

each of said coupling ends and said pivot ends of said first portion and said second portion of said body member have wall defining an aperture therethrough in said flattened section.

8. The arrangement defined in claim 7 and further comprising:

a pivot pin extending through said apertures in said pivot ends of said first portion and said second portion of said body member to allow said relative pivotal rotation thereof;

a locking pin extending through said apertures in said coupling ends of said first portion and said second portion of said body member to provide said detachable coupling together thereof.

9. The arrangement defined in claim 8 wherein:

said locking pin further comprises a bolt and nut;

said pivot pin further comprises a two headed rivet pin.

10. The arrangement defined in claim 2 wherein:

said loop sections of said first portion and said second portion are in substantially diametrically opposed relationship whereby a force applied to one of said loop sections directed outwardly pulls the other of said loop sections in the direction of the force applied.

11. A vessel mooring arrangement, comprising, in combination:

a wire body member having a first portion and a second portion, each of said first portion and said second portion having a coupling end and a pivot end;

said pivot end of said first portion pivotally coupled to said pivot end of said second portion to allow relative pivotal movement of said first portion with respect to said second portion;

said coupling end of said first portion detachably mountable on said coupling end of said second portion to provide detachable coupling therebetween to define a substantially ring configuration of said body member having a center line, said body member lying in a plane for the condition of said coupling end of said first portion detachably coupled to said coupling end of said second portion and an open configuration for the condition of said coupling end of said first portion detached from said coupling end of said second portion;

each of said first portion and said second portion having a loop section upstanding from said plane of said body member and intermediate said coupling end and said pivot end of each of said first portion and said second portion, said loop section of each of said first portion and said second portion extend both upwardly from said plane of said body member and outwardly away from said center line of said body member, and said loop section on said first portion is in substantially diametrically opposed relationship to said loop section on said second portion of said body member;

a plurality of float members having a density less than that of water and at least one of said plurality of float members mounted on each of said first portion and said second portion of said body member;

one of said plurality of float members adjacent each of said pivot ends and said coupling ends of said first portion and said second portion of said body member.

12. The arrangement defined in claim 11 wherein:

said body member is substantially circular in cross section and is tubular.

13. The arrangement defined in claim 11 wherein:

said body member is circular in cross section and is solid wire.

14. The arrangement defined in claim 11 and further comprising:

a strap member on each of said loop sections and surrounding said loop sections;

said strap members are in regions adjacent said plane of said body member.

* * * * *